US010086623B2

(12) United States Patent
Ratjen et al.

(10) Patent No.: US 10,086,623 B2
(45) Date of Patent: Oct. 2, 2018

(54) DEVICE FOR CIRCULATING AN INK SUPPLY TO AT LEAST ONE INKJET PRINT HEAD

(71) Applicant: HEIDELBERGER DRUCKMASCHINEN AG, Heidelberg (DE)

(72) Inventors: Hans-Juergen Ratjen, Bad Bramstedt (DE); Joerg-Achim Fischer, Laboe (DE); Claudia Harbs, Kiel (DE); Ingmar Nitsch, Kiel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/457,438

(22) Filed: Mar. 13, 2017

(65) Prior Publication Data

US 2017/0274669 A1 Sep. 28, 2017

(30) Foreign Application Priority Data

Mar. 24, 2016 (DE) ..... 10 2016 204 923

(51) Int. Cl.
*B41J 2/18* (2006.01)
*B41J 2/175* (2006.01)

(52) U.S. Cl.
CPC ..... *B41J 2/18* (2013.01); *B41J 2/17596* (2013.01)

(58) Field of Classification Search
CPC ..... B41J 2/18; B41J 2/17596
See application file for complete search history.

(56) References Cited

U.S. PATENT DOCUMENTS 4,539,568 A * 9/1985 Lewis ..... B41J 2/17593 137/341
6,352,324 B1 * 3/2002 Pagnon ..... B41J 2/175 347/6
9,199,479 B2 12/2015 Tomlin et al.
2007/0175144 A1 * 8/2007 Hakansson ..... B44C 5/0492 52/403.1

FOREIGN PATENT DOCUMENTS

DE 202008018433 U1 10/2013
DE 102013218952 A1 3/2015

* cited by examiner

*Primary Examiner* — Shelby Fidler
(74) *Attorney, Agent, or Firm* — Laurence A. Greenberg; Werner H. Stemer; Ralph E. Locher

(57) ABSTRACT

A device for circulating an ink supply to at least one inkjet print head includes at least two components that are different than the inkjet print head and through which ink flows, such as a pump and a valve for the ink. At least one ink line is connected between the components. At least one section of the ink line is embodied as a channel in a plate. The device advantageously has a compact construction and is easy to clean and service. The device has a high degree of reliability since the number of hose lines is advantageously reduced.

12 Claims, 4 Drawing Sheets

DEVICE FOR CIRCULATING AN INK SUPPLY TO AT LEAST ONE INKJET PRINT HEAD

CROSS-REFERENCE TO RELATED APPLICATION

This application claims the priority, under 35 U.S.C. § 119, of German Application DE 10 2016 204 923.2, filed Mar. 24, 2016; the prior application is herewith incorporated by reference in its entirety.

BACKGROUND OF THE INVENTION

Field of the Invention

The present invention relates to a device for circulating an ink supply to at least one inkjet print head. The device includes at least two components through which ink flows. The at least two components are different than the inkjet print head and at least one ink line is connected between the at least two components. The invention further relates to an inkjet printing machine including such an ink supply device.

The technical field of the invention is the field of inkjet printing and in particular the field of storing, conditioning, and feeding ink to one or more inkjet print heads. Known ink supply systems for inkjet print heads are usually formed of a plurality of individual components that are disposed so as to be spaced apart from one another and are connected to one another by connections embodied as hoses for transporting ink. Such ink supply systems usually require a large amount of installation space, a large proportion of which is taken up by the connecting hoses because they frequently do not tolerate small radii of curvature. In addition, such devices are difficult to clean and service and the large number of hoses presents functionality and reliability hazards because such hoses may loosen or be damaged, resulting in leaks that may cause problems.

SUMMARY OF THE INVENTION

It is accordingly an object of the invention to provide a device for circulating an ink supply to at least one inkjet print head, which overcomes the hereinafore-mentioned disadvantages of the heretofore-known devices of this general type, which does not take up much installation space and which has a compact construction. In addition, an object of the invention is to provide such a system that is easy to clean, easy to service and capable of operating at a high degree of reliability.

With the foregoing and other objects in view there is provided, in accordance with the invention, a device for circulating an ink supply to at least one inkjet print head, comprising at least two components through which ink flows, the at least two components being different than the print head, at least one ink line connected between the at least two components, and a plate having a channel forming at least a section of the at least one ink line.

The device of the invention advantageously needs only a little installation space and may thus advantageously be used in inkjet printing machines that provide only a little room for an ink supply system. The compact construction advantageously allows the device to be positioned close to or even very close to (e.g. adjacent) the print head that is to be supplied with ink, requiring only very short connecting hoses between the device and the head and thus having a positive impact on flow resistance.

Another advantageous aspect is that the device of the invention is easy to clean and service. The fact that the number of connections between components that are provided in the form of hoses is reduced may be seen as another advantage of the invention. This aspect advantageously improves the functional reliability of the ink supply system and reduces the risk that depends on the number and length of the hoses being used. The technical embodiment of the invention additionally simplifies assembly of the device.

The components may advantageously be separate units, in particular separate units that are removable from the plate (for instance by unscrewing them) for cleaning, servicing, and/or replacement purposes.

Each one of the channels in the plate (or in partial plates, see below) preferably has a channel inlet and a channel outlet. The channel inlet and the channel outlet of a channel may be on the same plate side or on opposite plate sides. The channels preferably do not branch out. A channel may extend substantially in the plane of the plate or it may be substantially perpendicular thereto. The channels are preferably milled into the plate. Channels may also be embodied as a bore through the plate. Most of the channels are preferably milled. In a particularly preferred embodiment, the channels are milled into the underside of the plate and the components are disposed on the upper side of the plate. In this case, the components are preferably connected to the channels by bores.

In order to seal the channels against one another, it may be envisaged that the partial plates are provided with sealing elements (around every channel). However, the preferred embodiment is to weld (e.g. in a laser welding process) or glue the partial plates.

The channels between the components are preferably as short as possible, in particular to minimize flow resistance.

The invention is also to be seen as encompassing an inkjet printing machine, e.g. a machine for multicolor printing, which is distinguished by at least one ink supply device constructed as described above with reference to the invention. An advantage of such a machine is that due to the fact that the ink supply device needs only a little installation space, the machine itself may likewise have a compact construction and is very reliable in terms of the supply of ink to the inkjet print heads.

In accordance with a preferred exemplary embodiment of the device of the invention, the plate may have a bipartite construction including a first plate and a second plate wherein the channel is formed in at least one surface of the first plate and the second plate covers at least the channel. This embodiment is distinguished by a simple and cost-efficient manufacturing process. In addition, it is particularly easy to clean and service.

The plate and the partial plates (first and second plate as well as third plate, see below) are preferably flat plates, in particular rectangular plates. The length of the plate is preferably greater than twice or three times the width of the plate. Finally, the height of the plate is preferably selected to be less than one tenth of the length of the plate.

A preferred embodiment of the device of the invention may be distinguished by one of the components being embodied as an ink reservoir and being disposed on at least one section of an underside of the first plate in such a way that the first plate forms at least a part of an upper side of the ink reservoir. This embodiment has a particularly compact construction because the channel plate and the reservoir may be combined to form a space-saving unit. Hose lines between the reservoir and further components may advantageously be dispensed with and may in particular be replaced by interior channels or tubing.

The plate, partial plates, and also the reservoir are preferably made of a plastic material such as POM or PA6 plastics. Alternatively, they may be made of metal.

A preferred embodiment of the device of the invention may be distinguished by at least a further one of the components being constructed as an ink heater. This embodiment likewise has a very compact construction because the channel plate, reservoir, and heater may be combined to form one space-saving unit. It is to be understood that this embodiment likewise avoids cumbersome hose lines to the heater and back.

A preferred embodiment of the device of the invention may be distinguished by the ink heater forming at least a part of an underside of the ink reservoir. This provides easy access to the heater for (separate) cleaning and service purposes. In addition, the heater may easily be replaced, for instance in the case of a malfunction, since it is accessible from outside. The heater may be constructed as a flow-through heater including a ribbed recuperator, preferably made of aluminum, and an electric resistor foil and may be constructed to heat the entire flow of ink that is needed to the required operating temperature in one pass. If the ink is UV ink, it is for instance heated to approximately 50° C.

A preferred embodiment of the device of the invention may be distinguished by at least a further one of the components being disposed on an upper side of the second plate. An advantage of this technical embodiment is that the component or even a plurality of such components are easily accessible from outside and may easily be replaced. An overall advantage is that the entire device may have a very compact construction.

A preferred embodiment of the device of the invention may be distinguished by the at least one further component being embodied as one or more of the following components: ink pump, valve for ink and/or cleaning fluid, ink filter and/or ink deaerator. An advantage in this context is that it is basically possible to integrate all components that are needed for supply purposes. Thus, the total installation space may be reduced to a considerable extent, distances between the components may be reduced, and long transport distances between components may be shortened.

The pump or pumps is/are preferably constructed in such a way as to ensure that they are capable of generating the required volume flow of ink and the required ink pressure. In particular, the so-called meniscus pressure of the ink on the print head may be generated and preferably controlled.

A preferred embodiment of the device of the invention may be distinguished by at least a further one of the components being disposed substantially in a hole, in particular a blind bore, in the plate. An advantage of this technical embodiment is that the installation space outside the plate may be reduced.

A preferred embodiment of the device of the invention may be distinguished by the further component being constructed as an ink pulsation damper.

A preferred embodiment of the device of the invention may be distinguished by the plate having a connector for an ink connection to the print head and a connector for an ink connection back from the print head. The respective connectors may be constructed as plug connections.

A preferred embodiment of the device of the invention may be distinguished by the device including at least three or more components that are different than the print head and through which ink flows and at least two or more ink lines between the components, wherein at least a section of each one of the ink lines is embodied as a channel in a plate. In a specific embodiment, as far as possible, all components of a circulation system would be connected by interior channels and/or tubing. Only the lines from an ink container (can, vat) to the device and from the device to the print head and back again would in this case be constructed as hose lines.

A preferred embodiment of the device of the invention may be distinguished by the plate being equipped with at least three components.

A preferred embodiment of the device of the invention may be distinguished by the configuration of the components on the plate having a high packing density. The packing density preferably ranges between approximately 0.026 components/$cm^2$ and approximately 0.204 components/$cm^2$, in particular between approximately 0.034 components/$cm^2$ and approximately 0.163 components/$cm^2$ or amounts to approximately 0.015 components/$cm^2$. A further preferred embodiment of the device of the invention may be distinguished by the configuration of the components on the plate being such that the distance between the components is preferably less than approximately 10 mm, in particular less than approximately 5 mm.

Other features which are considered as characteristic for the invention are set forth in the appended claims.

Although the invention is illustrated and described herein as embodied in a device for circulating an ink supply to at least one inkjet print head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
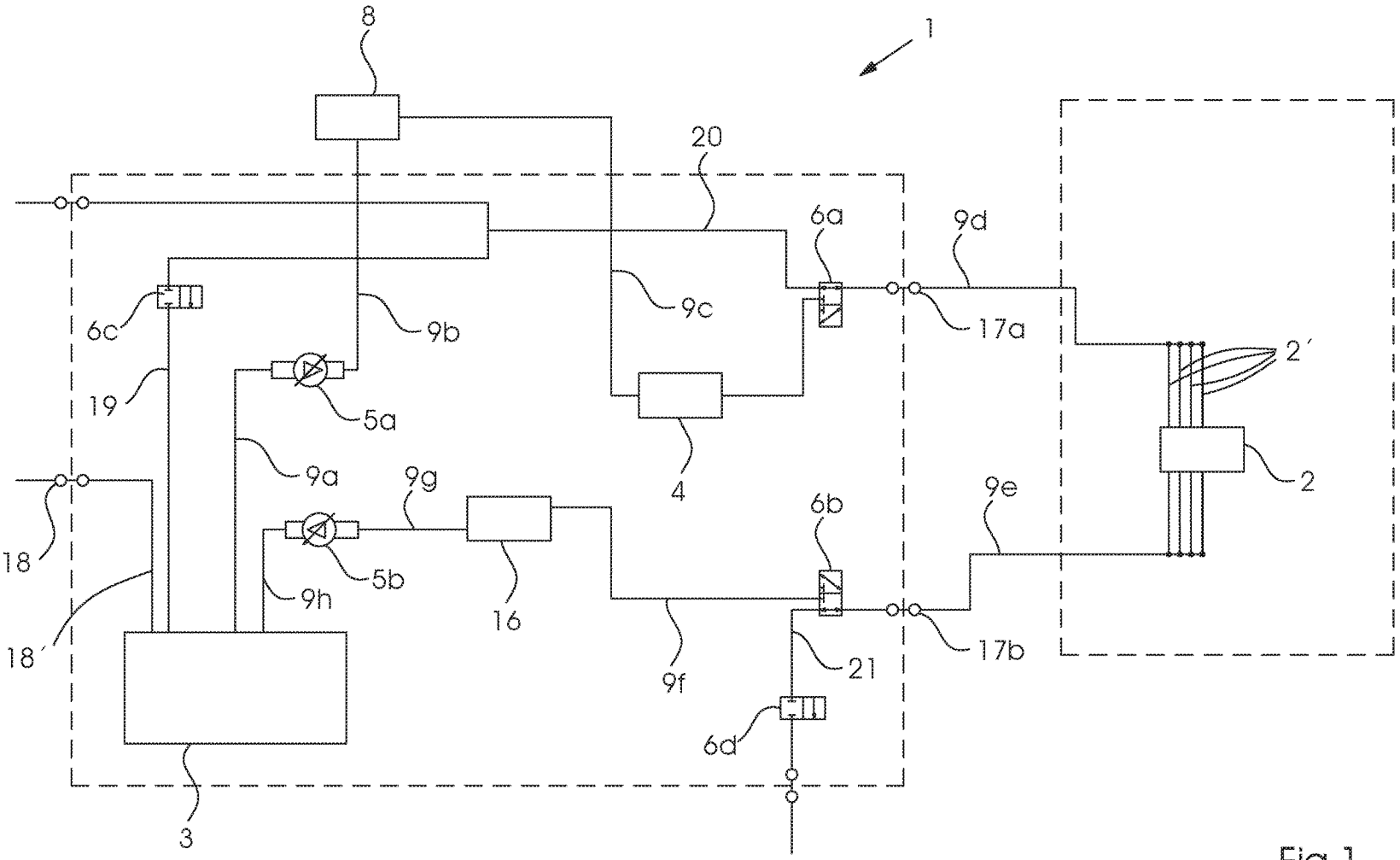
FIG. 1 is a schematic and block diagram of a preferred exemplary embodiment of the device of the invention.

Referring now to the figures of the drawings in detail and first, particularly, to FIG. 1 thereof, there is seen a basic configuration of a preferred exemplary embodiment of an ink supply device 1 of the invention. The device is used to supply liquid ink to a print head 2 or to a number of print heads. A distribution system known as a manifold is provided for every print head or jointly for a number of print heads connected in parallel and is disposed close to the print head(s). The manifold 2' disposed close to the print head acts to distribute the ink supplied to the print head to the individual components of the print head and to the individual nozzles of the print head. The manifold must not be confused with the channel(s) of the invention (which are further away from the print head). They are different elements.

The ink is stored in an ink reservoir 3 that has a connector 18 to an ink line 18' connecting the reservoir 3 to a larger (non-illustrated) ink supply such as a can or vat (or bag or bag-in-the-box) to fill the ink reservoir 3. The connector 18 may be located on the reservoir itself or on a plate 11 described below.

An ink filter 7 (which is not shown in FIG. 1) may be provided in the ink line 18' to ensure that any contamination or components that might compromise the printing process are filtered out of the ink that is supplied to the reservoir.

Ink travels from the reservoir 3 through a line 9*a* and a pump 5*a* as well as a line 9*b* to an ink deaerator 8. The ink deaerator 8 ensures that the ink is separated from any air bubbles that may be contained therein or vice versa. A line 9*c* then guides the ink from the ink deaerator 8 to an ink heater 4 (or temperature control element as a more general term), which ensures that the ink has the appropriate temperature for the printing process. A line 9*d* containing a valve 6*a* guides the ink from the heater to the print head 2 or rather to the connector thereof to the manifold 2' that is close to the print head.

Ink that has not been used by the print head 2 is guided to an ink pulsation damper 16 through the manifold 2' and a line 9*e*, which also contains a valve 6*b*, and a line 9*f*. The ink pulsation damper ensures that pressure fluctuation and in particular pressure peaks of the conveyed liquid ink are reduced to a level that does not cause any visible defects in the printed image. A line 9*g* then feeds the ink to a second pump 5*b* and finally through a line 9*h* back to the reservoir 3.

Each one of the ink lines 9*d* and 9*e* may be connected to and disconnected from the other lines and components of the ink supply 1 through respective connectors 17*a* and 17*b*.

A cleaning fluid may be fed to the ink supply device 1 and to the print head 2 or rather the manifold 2' thereof through cleaning fluid lines 19, 20, and 21 by switching the valves 6, in particular the valves 6*a*, 6*b* and 6*d*. This allows ink to be removed and cleaned off from all lines and components, for instance to prevent ink from drying up after the printing process has been completed and to allow ink of a different color to be used.

Figure 2:
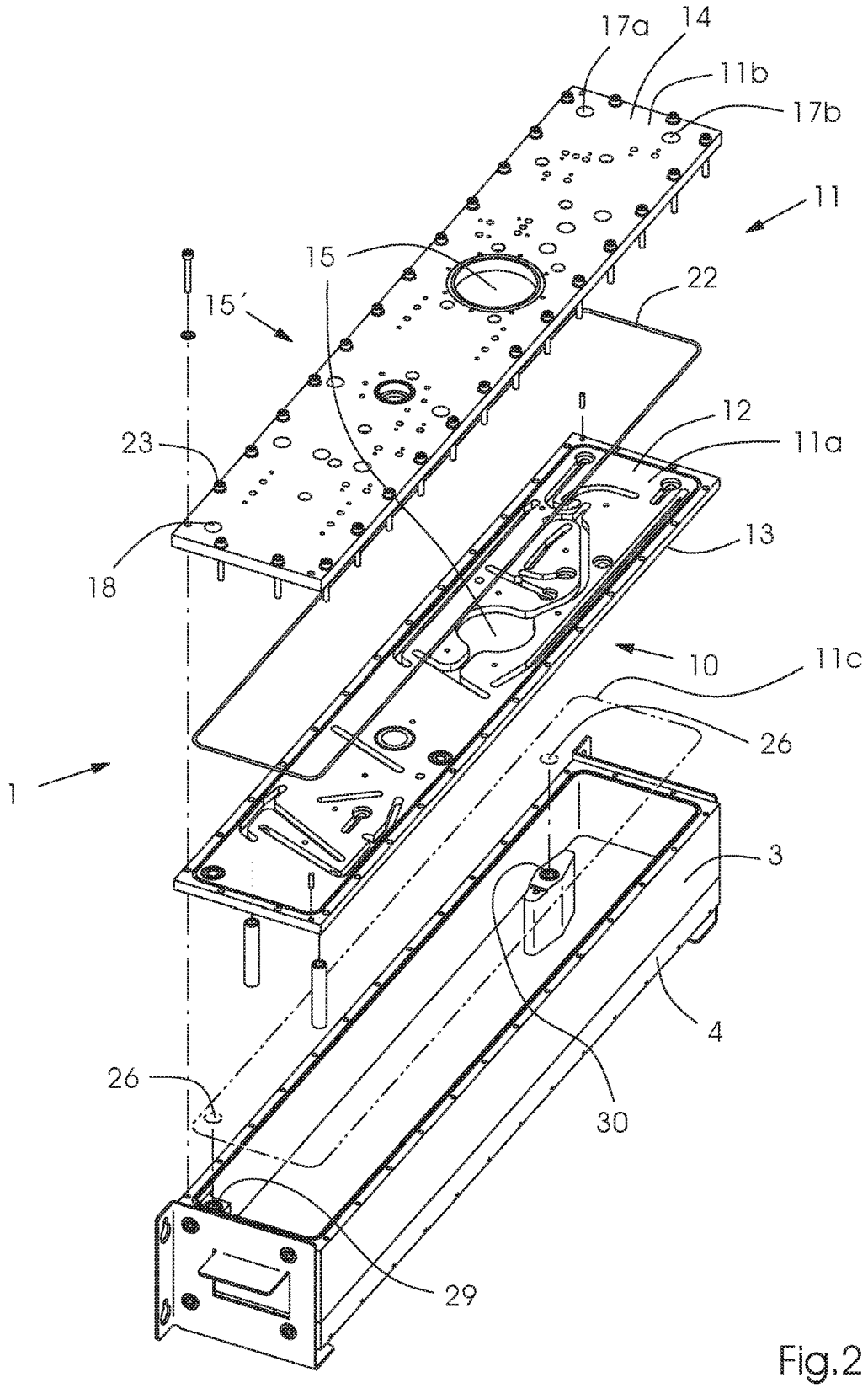
FIG. 2 is a diagrammatic, exploded perspective view of parts of a preferred exemplary embodiment of the device of the invention.

The construction, including the interior construction of a part of the ink supply device 1 of the invention, will become apparent to those skilled in the art from the exploded view shown in FIG. 2. An important element of the invention is the plate 11. In the illustrated preferred exemplary embodiment, the plate 11 includes a first plate 11*a* (referred to as the channel plate), a second plate 11*b*, and a third plate 11*c*. In order to make the elements of the reservoir or tank 3 that are located underneath better visible, the third plate is shown to be transparent. A further feature that is important to the invention is a channel 10 or a plurality of channels 10 formed in the plate 11 or rather in the first plate 11*a* (in particular in a surface 12 thereof). The channel(s) 10 formed in the plate 11 (or rather 11*a*) guide ink from one component to another component of the device 1. The components, for instance a valve and a pump, are preferably disposed on an upper side 14 of the plate 11 or rather of the second plate 11*b*. For this purpose, the plate 11 or rather the second plate 11*b* has openings, i.e. through-holes allowing the ink to pass from one component to another and through the channel 10. The second plate may be 20 mm in thickness.

At this point it is to be pointed out that the terms "upper side" and "underside" as well as "above" and "below," which will be used further down, do not necessarily refer to a vertical alignment but rather to a position relative to one another. This means that an "upper side" and an "underside" represent mutually opposite sides in terms of a defined direction. In the preferred embodiment of the invention, this direction is the vertical direction. However, it is possible to rotate the device 1 through an angle of 90°, for instance, turning the "upper side" into a "left-hand side."

A sealing ring 22 is disposed between the first plate 11*a* and the second plate 11*b*. The sealing ring 22 prevents ink from leaking between the assembled plates 11*a* and 11*b* in a lateral direction. The third plate 11*c* is used as a cover for the first plate 11*a* on the side opposing the plate 11*b* and allows ink to pass only though holes 26. Sealing rings may likewise be disposed between the third plate 11*c* and the first plate 11*a* and between the third plate and the ink reservoir 3.

The ink reservoir 3 is disposed on the underside 13 of the plate 11 or rather of the third plate 11*c*. The ink reservoir 3 includes an ink heater 4, which is in turn disposed on the underside of the ink reservoir 3. Channels 29 and 30 (or tubes or tube pieces) may be disposed in the interior of the reservoir to allow ink to pass from the upper side of the reservoir (i.e. the plate) to the underside of the tank (i.e. the heater) and back again. Alternatively, further channels may be provided, for instance in the side walls of the reservoir.

A connector 18 allows ink to travel into the ink reservoir 3 from an external ink supply through the plate 11 and the channel(s) 10. The ink is fed from the ink reservoir through the heater 4 in order to be heated up for the printing process and back to the plate 11, i.e. to the channel(s) 10. Then, the ink passes through a connector 17*a* and through a line leading to the print head 2 and from there unused ink returns to a connector 17*b* through a further line.

The illustrated plates 11*a*, 11*b* and 11*c* as well as the ink reservoir 3 are preferably assembled by using screw connections 23.

A person skilled in the art will notice a large circular opening 15 formed in the plate 11, i.e. in the plates 11*a* and 11*b*. This opening, which is preferably formed as a blind bore in the plate 11*b*, may receive an ink pulsation damper 16 (preferably a stainless steel membrane). This damper is preferably likewise connected to further components of the ink supply through the channel/s 10. The plate 11, i.e. the second plate 11*b*, has a number of further holes 15'. They are partly used to mount the individual components (and have screw threads, for instance) such as the deaerator 8, the heater 4, the pumps 5 or the valves 6. On the other hand, the holes are used to pass ink through the plate 11*b* to the other components.

Those skilled in the art will also realize that the channel(s) 10 in the plate 11, i.e. in the first plate 11*a* in FIG. 2, may be constructed as through-holes. However, it is also possible for the channel/s 10 to be at least partly embodied as blind holes. If the plate 11, i.e. the second plate 11*b*, is provided with at least three components, at least two channels 10 are provided in the plate 11, i.e. in the first plate 11*a*. Even when as few as two channels 10 or in particular when several channels 10 or even a plurality of channels 10 are provided in the plate 11, i.e. in the first plate 11*a*, the channels may have to be curved at least in sections or may need to have multiple curves (in an S shape or a meandering shape) instead of being just straight. It may further be necessary to orient the channels in different directions within the plate 11, i.e. the first plate 11*a*. For instance, there may be channels that are substantially parallel to a longer side edge of the plate and/or there may be channels that are substantially parallel to a shorter side edge of the plate. In addition, it may be envisaged that channels merge. The channel(s) may have a circular extension on one or both ends corresponding to matching holes in the second plate 11*b*. The plurality of channels may form a channel system of channels with individual channels planned to be as short as possible and to have no or only a few curves.

Figure 3:
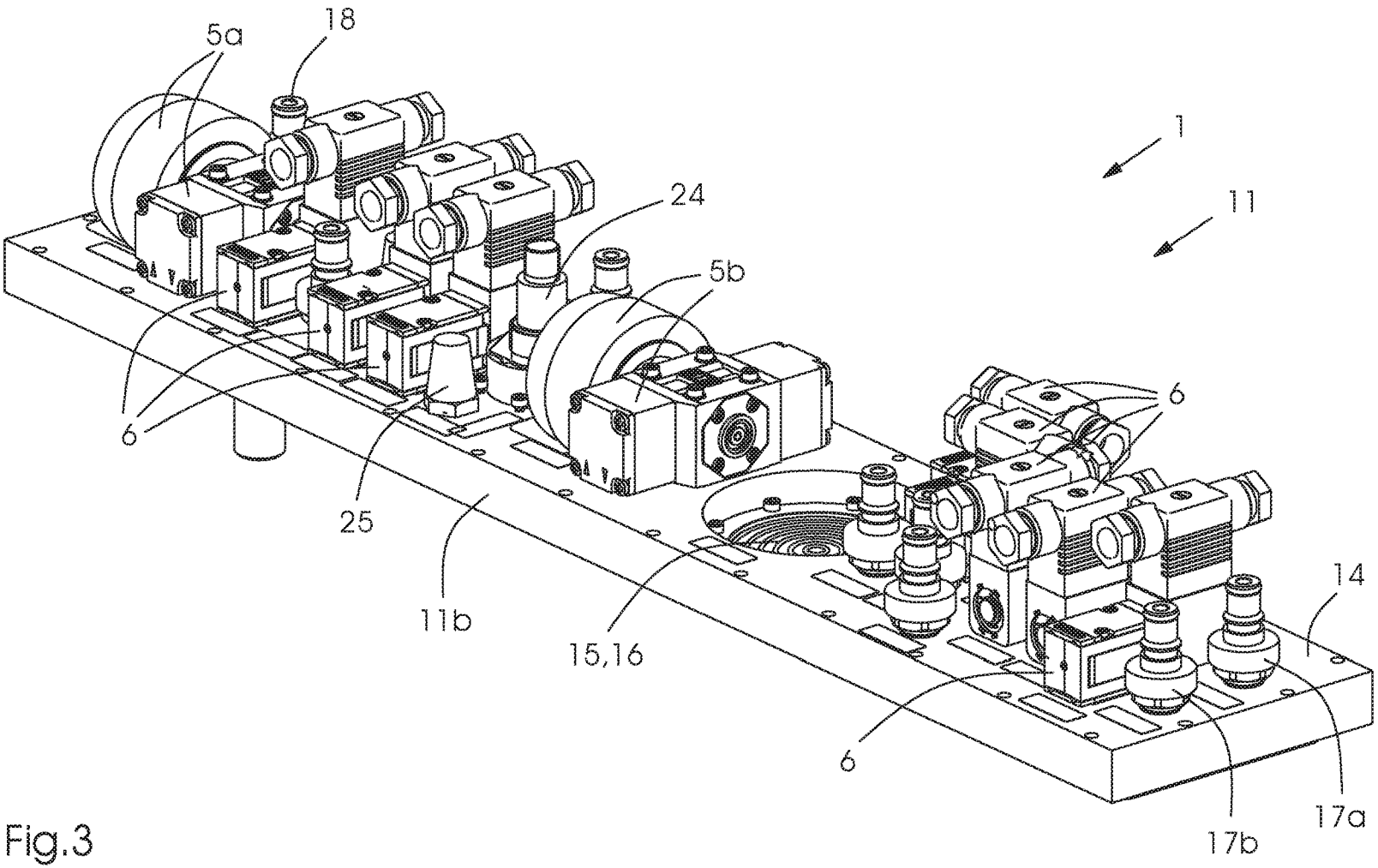
FIG. 3 is a perspective view of a plate equipped with components as a part of a preferred exemplary embodiment of the invention.

In the perspective view of the preferred exemplary embodiment of the invention shown in FIG. 3, those skilled in the art will recognize the plate 11, i.e. the second plate 11*b* thereof, and a plurality of components mounted to the plate: ink pumps 5*a* and 5*b*, ink and/or cleaning fluid valves 6, an ink pulsation damper 16 in a hole 15, connectors 17*a*, 17*b* and 18, a fill level sensor 24 and a ventilation element 25. The fill level sensor 24 extends through the plate 11 and into the ink reservoir 3 located underneath to measure the ink level therein. The reservoir is controlled by the sensor so as to be filled with ink from a larger supply. The ventilation element 25 allows ambient air to enter into the ink reservoir 3 to provide a way of balancing pressure if necessary. Thus, the two (additional) components 24, 25 do not need to be connected to the channel/s 10.

The components are positioned as closely as possible on the upper side 14 of plate 11, i.e. the plate 11*b*, allowing the plate and the ink reservoir 3 located underneath to be as compact as possible. The drawing of FIG. 3 clearly shows that a dense configuration of this type is only possible if no hoses are needed to connect the components. The incorporation of a channel or of several channels 10 into the plate 11 considerably reduces the required number of hose connections, advantageously allowing a dense configuration of a plurality of different components on the plate 11.

Figure 4:
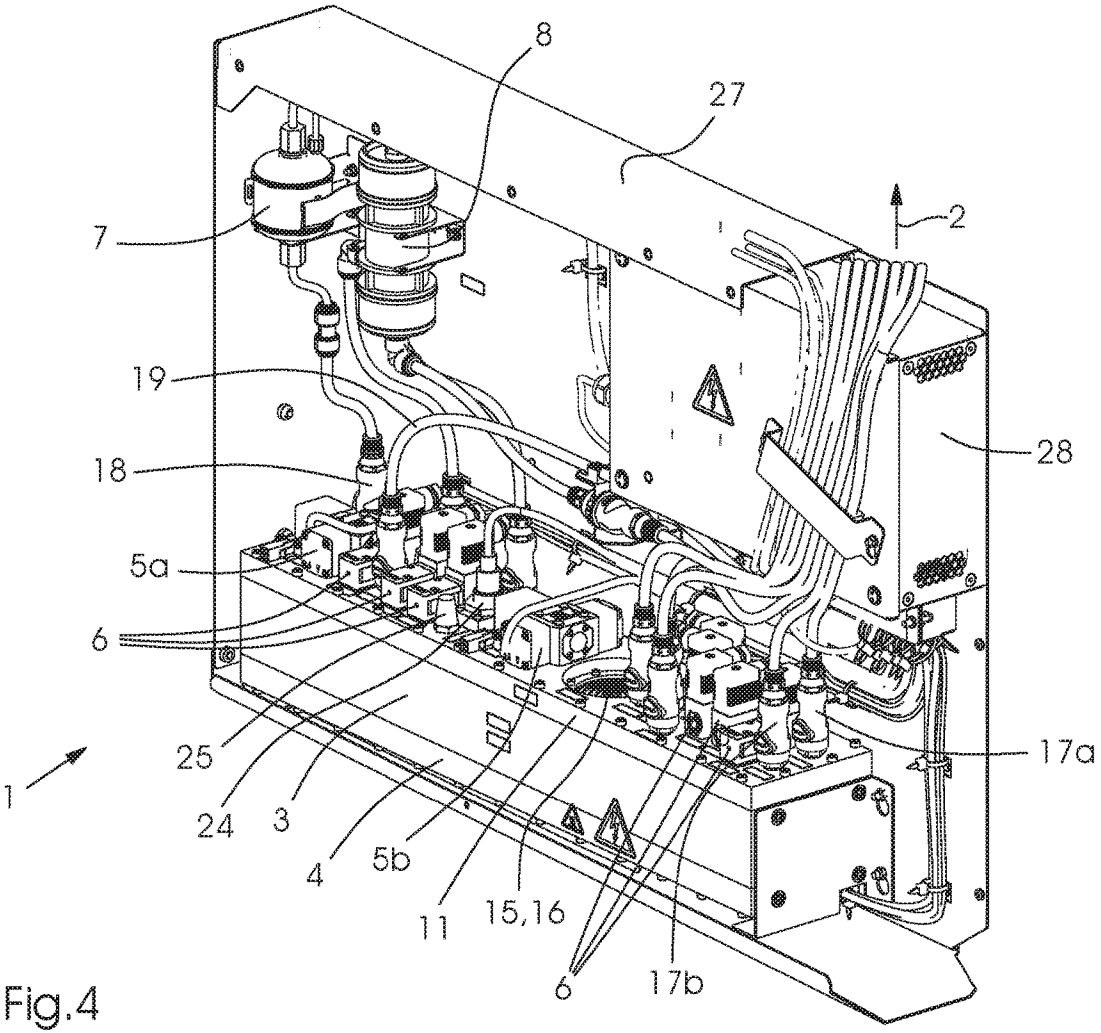
FIG. 4 is a perspective view of a preferred exemplary embodiment of the device of the invention.

The perspective view of the ink supply device 1 shown in FIG. 4 illustrates the advantageously compact construction. The plate 11, the ink reservoir 3 and the ink heater 4 form a substantially cuboidal part in the lower region of the device 1. The components are disposed on the upper side of the cuboid as shown in FIG. 3.

FIG. 4 shows that a component 7, i.e. the ink filter and a component 8, i.e. the ink deaerator, are not envisaged as part of the components disposed thereon. In the illustrated preferred embodiment, a reason for this is that these two components by themselves need much more installation space than the further components that are suitable for placement on the plate 11. However, even the components 7 and 8 may be mounted on the plate 11, in particular if they are replaced by very compact units instead of the ones that are shown in the drawing. In this case, even more hoses may advantageously be dispensed with.

FIG. 4 further indicates that a hose packet that for instance leads to the print head(s) 2 exits on the upper right corner of the illustrated device 1. FIG. 4 further indicates that the ink supply device 1 of the invention is integrated into a housing or partial housing 27, which may also contain an electronic system 28. The electronic system 28 is mainly used to actuate the individual components in the configuration on the plate 11 as well as the heater 4 and to supply power thereto. The housing may be used as a module in a printing machine for inkjet printing. If a plurality of print heads are operated and in particular if inks of different colors are applied, a plurality of such modules may be provided and may for instance be placed next to one another. When printed products are created in a CMYK process, a person skilled in the art would provide at least four such modules.

The invention claimed is:

1. A device for circulating an ink supply to at least one inkjet print head, the device comprising:

at least two components through which ink flows, said at least two components being different than the inkjet print head;

at least one ink line connected between said at least two components; and a plate having a channel forming at least sections of said at least one ink line, said plate having a bipartite construction including a first plate and a second plate, said channel being formed at least in a surface of said first plate, and said second plate covering at least said channel;

one of said components being an ink reservoir disposed on at least a section of an underside of said first plate, and said first plate forming at least a part of an upper side of said ink reservoir;

at least a further one of said components being disposed on an upper side of said second plate.

2. The device according to claim 1, wherein at least a further one of said components is an ink heater.

3. The device according to claim 2, wherein said ink heater forms at least a part of an underside of said ink reservoir.

4. The device according to claim 1, wherein said at least one further component is at least one component selected from the group consisting of an ink pump, a valve, an ink filter and an ink deaerator.

5. The device according to claim 1, wherein at least a further one of said components is disposed partly in a hole in said plate.

6. The device according to claim 1, wherein said plate includes a connector for an ink line leading to said print head and a connector for an ink line leading back from said print head.

7. The device according to claim 1, wherein:

said at least two components include at least three components through which ink flows, said at least three components are different than the inkjet print head;

said at least one ink line includes at least two ink lines connected between said at least three components; and at least a section of said ink lines is formed as said channel in said plate.

8. The device according to claim 7, wherein said plate is equipped with at least three of said components.

9. The device according to claim 8, wherein said components on said plate are densely packed.

10. The device according to claim 8, wherein said components on said plate are spaced apart by a distance of less than 10 mm.

11. The device according to claim 8, wherein said components on said plate are spaced apart by a distance of less than 5 mm.

12. A device for circulating an ink supply to at least one inkjet print head, the device comprising:

at least two components through which ink flows, said at least two components being different than the inkjet print head;

at least one ink line connected between said at least two components; and a plate having a channel forming at least sections of said at least one ink line;

at least a further one of said components being disposed partly in a hole in said plate, said further component being an ink pulsation damper.

* * * * *